US008845564B2

(12) United States Patent
Cascini et al.

(10) Patent No.: US 8,845,564 B2
(45) Date of Patent: Sep. 30, 2014

(54) MASSAGING DEVICE

(76) Inventors: Antonio Cascini, Vimercate (IT); Daniela De Pasquale, Milan (IT); Davide Roncuzzi, Ravenna (IT)

( * ) Notice: Subject to any disclaimer, the term of this patent is extended or adjusted under 35 U.S.C. 154(b) by 638 days.

(21) Appl. No.: 13/140,459

(22) PCT Filed: Dec. 19, 2009

(86) PCT No.: PCT/IB2009/007832
§ 371 (c)(1),
(2), (4) Date: Jul. 12, 2011

(87) PCT Pub. No.: WO2010/070440
PCT Pub. Date: Jun. 24, 2010

(65) Prior Publication Data

US 2011/0264020 A1 Oct. 27, 2011

(30) Foreign Application Priority Data

Dec. 19, 2008 (IT) ..... RA2008A0050

(51) Int. Cl.
*A61H 7/00* (2006.01)

(52) U.S. Cl.
CPC ..... *A61H 7/007* (2013.01); *A61H 2201/165* (2013.01); *A61H 7/001* (2013.01); *A61H 2205/081* (2013.01); *A61H 2201/0207* (2013.01)
USPC ..... 601/134; 601/15; 601/95; 601/112

(58) Field of Classification Search
USPC ..... 601/46, 15, 84, 85, 86, 87, 89, 90, 93, 601/95, 108, 112, 113, 134, 135; 606/201
See application file for complete search history.

(56) References Cited

U.S. PATENT DOCUMENTS

| | | | | |
|---|---|---|---|---|
| 3,881,470 | A | 5/1975 | Glore | |
| 7,207,953 | B1 | 4/2007 | Goicaj | |
| 2002/0183666 | A1 | 12/2002 | Suh | |
| 2004/0127822 | A1 | 7/2004 | Eisenberg | |
| 2005/0059909 | A1 | 3/2005 | Burgess | |
| 2008/0177206 | A1 | 7/2008 | Tung | |
| 2009/0204034 | A1 * | 8/2009 | May | 601/15 |
| 2010/0152632 | A1 * | 6/2010 | Schupman | 601/135 |

OTHER PUBLICATIONS

European Search Report mailed Jul. 21, 2010.
International Preliminary Report on Patentability dated Mar. 29, 2011.

* cited by examiner

*Primary Examiner* — Quang D Thanh
(74) *Attorney, Agent, or Firm* — Abelman, Frayne & Schwab

(57) ABSTRACT

A massaging device provided with an operating unit comprising a respective massaging unit designed so as to exert, in use, an action similar to a finger pressure; a coupling unit being provided in order to maintain the operating unit stably into contact with a rear muscular region of a user, positioned between respective scapular regions.

16 Claims, 3 Drawing Sheets

Fig. 1
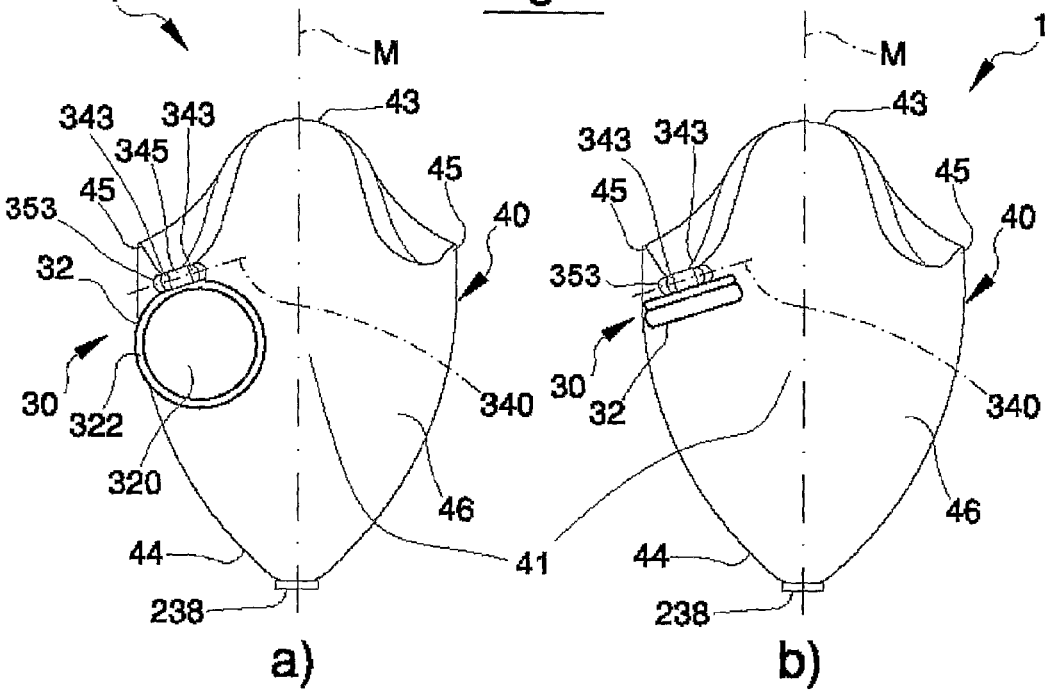
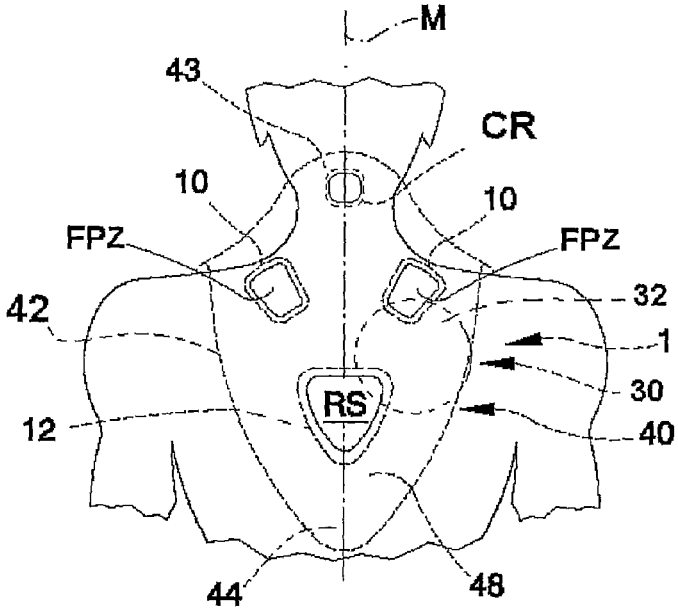
Fig. 2

Fig. 3
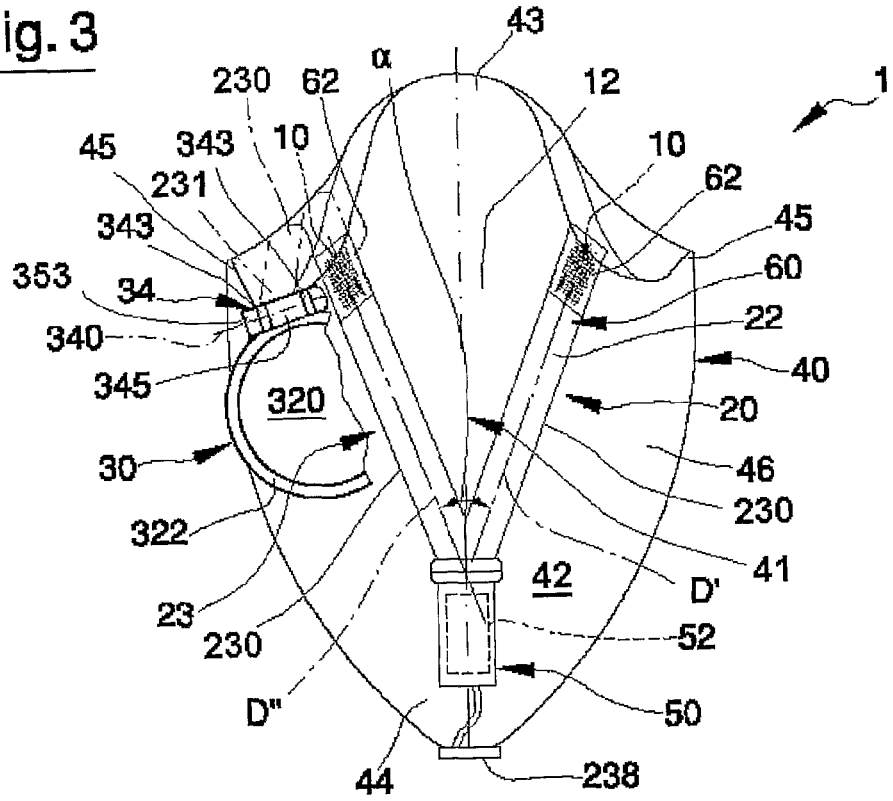
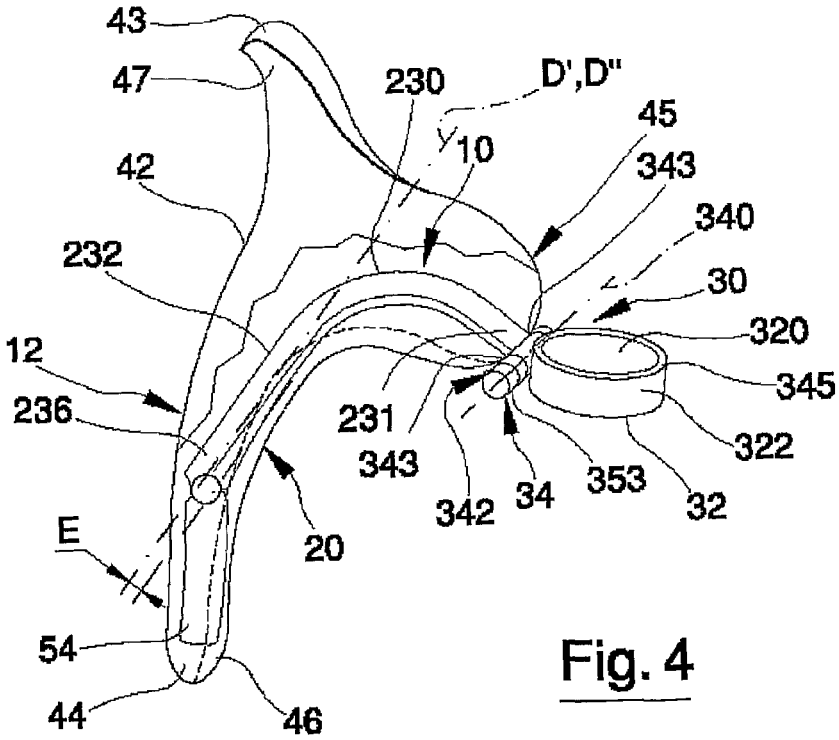
Fig. 4

Fig. 5
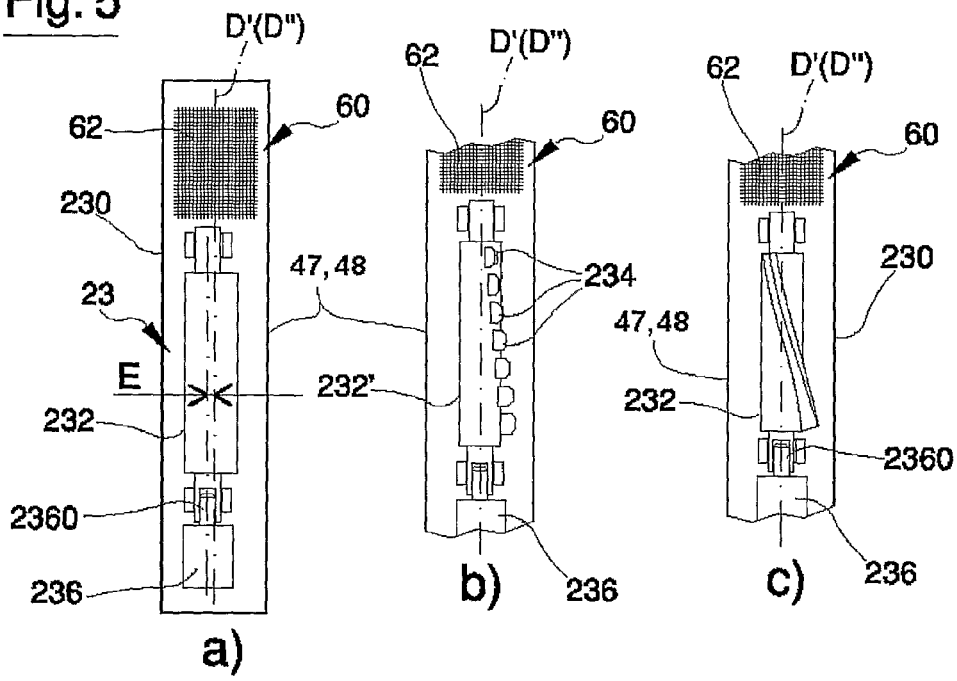
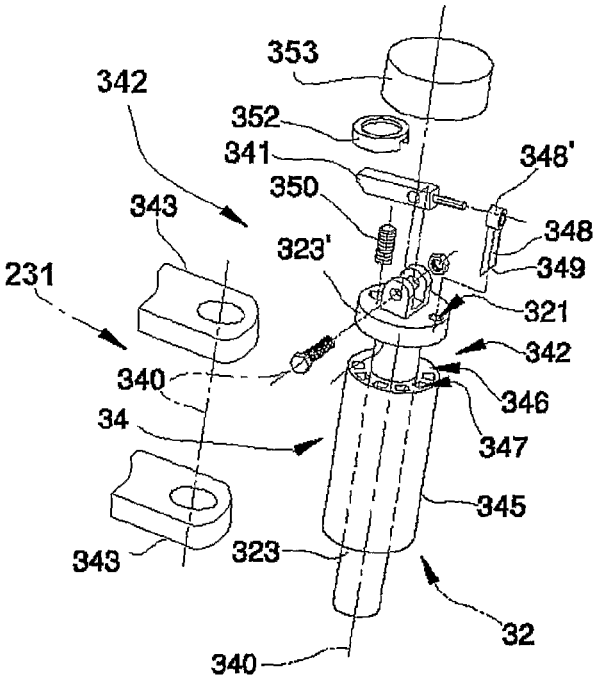
Fig. 6
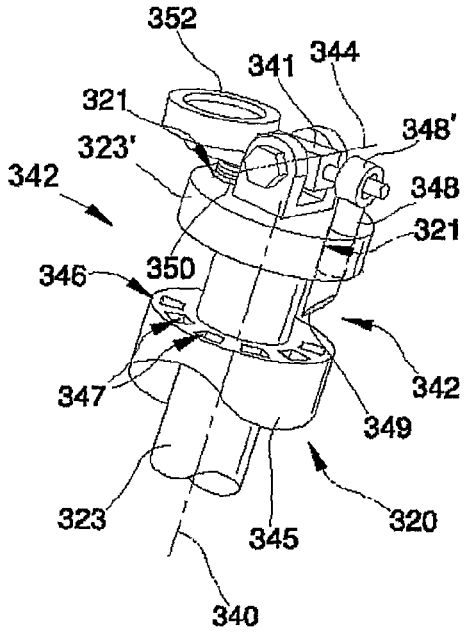
Fig. 7

MASSAGING DEVICE

CROSS REFERENCE TO RELATED APPLICATIONS

This application is a national phase of PCT application No. PCT/IB2009/007832, filed Dec. 19, 2009, which claims priority to IT patent application No. RA2008A000050, filed Dec. 19, 2008, all of which are incorporated herein by reference thereto.

The present invention relates to a massaging device of the wearable type. In particular, the present invention relates to a massaging device of the type that can be worn by a user and that can be validly used to treat a muscular region next to the cervical and dorsal rachis of a user. In more detail, the present invention relates to a massaging device of the wearable type, which can be validly used to treat a muscular region next to the cervical and dorsal rachis of a user and comprising a group designed so as to exert, in use, an action similar to a local finger pressure.

BACKGROUND TO THE INVENTION

In the field of the devices for treating muscular contractures, which can affect the muscles next to the cervical rachis, apparatuses of the fixed type are well known, which are provided with massaging groups embodied inside the backs of armchairs or which can be applied in a rigid or immovable manner to a bed or to the upper portion of the back of a seat. Deliberately without considering devices of the fixed type as they must be used in lying or sitting position, and anyway for domestic or similar uses, devices of the wearable type are well known for treating the cervical pain, which are shaped similarly to collars completely surrounding the neck area and which present heights of different extension according to the performances for which they have been designed, which are therefore more practical to be used. Generally, most of these apparatuses is able to supply heat, whose effect is that of relaxing the muscular contracture, to which the pain is associated. In other cases, an action of touching can be associated to the heat supply so as to mime the movement of the fingers of a physiotherapist. In particular, reference is made to the teachings of some patent documents, the most significant of which are listed below. In particular, the European patent document EP 0784968 gives teachings to construct an inflatable device for treating the vertebral column. This device is provided with a substantially cylindrical portion, which is shaped so as peripherally to surround the neck and is provided with a plurality of laces usable to open it laterally so as to adjust an annular pressure thereof. This substantially cylindrical portion is provided with a plurality of inflatable elements and it is delimited at the top by a sort of collar, suitable to support the head, and at the bottom by a base, shaped so as to rest on the chest and the shoulders, so as to be suitable to exert a traction action on the user's neck. This apparatus is provided with a so-called electrotherapy device, which can be connected in a substantially adhering manner to the area to be treated for supplying heat. The patent document U.S. Pat. No. 5,916,185 describes a device for exerting traction of the cervical tract by using an inflatable member, which is U-shaped to surround, at the back and at the side, the neck of a user, and is provided with a band surrounding the user's head at the height of the forehead to be hold between the respective shoulders and the nape during cycles of traction of the neck. The traction is exerted through a pneumatic pump, which can be also manual, according to the given teachings. In the patent application US 2005/059909 a collar is described, which is produced in foam or rubber, is U-shaped and is provided with straps to be applied to the neck of a user in a substantially matching manner. This device integrates, at the rear, a heating unit and a massaging unit provided with an eccentric body put into rotation by an electrically powered motor. Heating and vibration are therefore supplied in the same region of the neck. As it is well known, whilst the application of heat in the cervical area is allowed and only has beneficial effects, the case of cervical massage is different, as it must be performed by a specialist so as not to jeopardize the patient's safety. These notes are surely known by the Applicant of this patent application, who will provide massages of low entity, to which absolutely soft and therefore substantially ineffective actions are associated, so as not to cause damages to the rachis of the users.

With reference to the patent application US2002/0183666, a device is illustrated, wherein a frame, which can be worn by using a pectoral band, houses an inflatable device provided with two mutually adjacent guides, so as to assume symmetric positions relative to the vertebral columns of a user, to which an inflatable cushion is associated at the rear, supplied by a compressed air mini-generator. Each guide carries slidable a massaging unit and the alternating inflating and deflating action of the cushion produces a pressure on the two massaging units towards the muscles of the user, similar to the localised finger pressure. The two massaging units are coupled to each other, by means of a belt motorised through an electric motor, so as to be movable with alternating motion along their own guide. In addition, it is possible to couple a heating device, which is not illustrated, to this massaging device, in order to give benefits described in a generic manner. In this case the massaging action is always in phase opposition, and therefore unbalanced. Furthermore, the motorisation of the massaging units and the compressed air generator are outside the wearable frame and are contained inside a box, the most adequate arrangement of which is not described. Obviously, the pectoral band allows to maintain the frame, and therefore the massaging units, into contact with the user's back. It should be noted that the frame is shaped in a substantially flat manner, notwithstanding two portions touching at the back the shoulders of a user. It should be noted that releasing the pectoral band causes sliding of the device downwards due to gravity, with possible negative consequences for the user and, surely, for the device. In view of what described with reference to the patent application US2002/0183666, it is clearly apparent that the device in question results to be poorly effective, noisy, due to the continuous inflating and deflating of the cushion, bulky, uncomfortable to be worn and invasive, and it is therefore poorly adequate for working contexts.

With reference to the patent application US2004/0127822, a plurality of massaging devices for the back are described, coupled to a chair for hairdressing salons. Among the various devices, one is described, which can be separated from the chair, without specifying whether it is portable or not, even if it is difficult to understand how it can be worn without the continuous supporting action exerted by a user, due to the deformation illustrated in FIG. 15. In this case again it is possible to note the combination of massaging and heating elements, carried by a frame, which is limited at the top by a sort of housing for the region of the vertebra 7 of the cervical rachis. With reference to the first massaging elements, the teaching is given of using rotatory elements arranged adjacent to each other, so as to be arranged symmetrically relative to the spine of a user; among these elements, two are arranged transversally to the back of a user, at the side of the cervical rachis, and two are substantially cylindrical, arranged in an underlying position and adjacent to each other; each longitudinal rotatory element is provided with an elongated helix in a position deemed to be immediately adjacent to the spine. The heating effect seems to be obtained through a pair of coils, one of which seems to be arranged above the rotatory elements and the other surrounds laterally and inferiorly the two longitudinal massaging elements. It is easy to understand that the device has been designed paying low attention to the real needs of people suffering from muscular-tension cervicodynia and with a lot of mechanical and heating devices. It cannot be ignored that the actuation of these devices requires a great availability of electricity, which can be supplied only through mains connection or through an heavy and bulky battery, which is hardly portable, unless to complicate the unwell status induced by the cervicodynia. It is not surprising that the patent application does not mention how the device is powered to allow functioning thereof, and that the device is not therefore really portable.

In view of the above description, the problem of treating the muscles next to the cervical rachis in an adequate manner through an effectively wearable device is solved in an unsatisfactory manner according to the teachings of the patent literature related to this sector, and it represents an interesting challenge for the applicant, which desires substantially to modify and to wide the market of these products.

In view of the above description it would be desirable to have available a massaging device that, in addition to limit and possibly to overcome the typical drawbacks of the art illustrated above, could define a new standard for these products.

SUMMARY OF THE PRESENT INVENTION

The present invention relates to a massaging device of the wearable type. In particular, the present invention relates to a massaging device of the type that can be worn by a user and that can be validly used to treat a muscular region next to the dorsal and cervical rachis of a user. In more detail, the present invention relates to a massaging device of the wearable type that can be validly used to treat a muscular region next to the dorsal and cervical rachis of a user and comprising a group designed so as to exert, in use, an action similar to a local finger pressure.

The object of the present invention is to provide a massaging device, which allows the disadvantages described above to be solved, and which is suitable to satisfy a plurality of requirements that to date have still not been addressed, and therefore suitable to represent a new and original source of economic interest and capable of modifying the current market of the portable and wearable massaging devices.

According to the present invention, a massaging device is provided, whose main characteristics will be described in at least one of the appended claims.

BRIEF DESCRIPTION OF DRAWINGS

Further characteristics and advantages of the massaging device according to the present invention will be more apparent from the description below, set forth with reference to the accompanying drawings, which illustrate at least one non-limiting example of embodiment, in which identical or corresponding parts of the device are identified by the same reference numbers. In particular:

FIG. 1 is a front view of a preferred embodiment of a massaging device according to the present invention illustrated with an its own functional group used to actuated two different operative modes;

FIG. 2 is a rear view of FIG. 1*a*);

FIG. 3 is a variant of FIG. 1*a*), with parts in cross-section and parts removed for the sake of clarity;

FIG. 4 is a side elevation view of FIG. 1*b*);

FIG. 5 is a front view in enlarged scale of a detail extracted from FIG. 3;

FIG. 6 is a first exploded view of a detail extracted from FIG. 3, in enlarged scale and with some parts removed for the sake of clarity; and FIG. 7 is a second schematic perspective view in enlarged scale and with some parts removed for the sake of clarity of FIG. 6.

DETAILED DESCRIPTION OF THE PRESENT INVENTION

In FIG. 1 number 1 indicates, in its entirety, a portable massaging device, which can be worn by a user and is electrically autonomous, which can be used to treat validly a muscular region next to the dorsal and cervical rachis of a user, in particular in people suffering from muscular-tension cervicodynia. This device 1 comprises a frame 5, to which a substantially rigid shell 42 is stably associated, which presents an elongated central portion 41, longitudinally delimited in FIG. 1 by a first longitudinal upper portion 43 and by a second longitudinal lower portion 44. In particular, this first portion 43 is shaped so as to couple in a substantially matching manner with the neck of a user in the area CR, arranged between the vertebra no. 7 and a respective occipital region, whilst the second portion 44 is substantially flat and it is designed so as to engage a central, substantially subscapular area of the back, as it will be better explained below. The shell 42 is delimited at the sides by two lateral portions 45, each of which extends starting from the first longitudinal portion 43 towards the chest of a user, and it is therefore concave and curved to cover, in use, a shoulder of a user in a complete and substantially matching manner. In this way, the two lateral portions 45 can support the shell 42 and hold it stably in a given position with the respective central portion 41 facing the first muscular region RS and the first portion 43 substantially into contact with the cervical rachis starting from the preparatory phases preceding and following the use of the device 1, as it will be more apparent from the present description.

This shell 42 is furthermore lined interiorly with a coating 46, indicated only in FIGS. 1 and 4 for the sake of practicality. The frame 5 supports, at the portion 41, an operating unit 20 in a position below the coating 46; this operating unit 20 comprises a massaging unit 23, designed so as to exert, in use, an action similar to a local finger pressure at the side of an infrascapular area/region RS, corresponding to the dorsal rachis and comprising the scapular levator muscles, the rhomboid muscles, and the trapezius muscles, through a pair of elongated members 232, which will be better described below.

For the sake of practicality, the muscular areas CR, RS, and FPZ have been illustrated in FIG. 2, wherein the device 1 has been represented through a broken line, to highlight that the respective outer profile has been traced to delimit widely in use the areas indicated above. To make understanding of the description of the present invention easier, in the shell 42 areas 10 and 12 have been identified, localised in given positions to cover, in use, the areas FPZ and RS respectively of the body of a user, better shown in FIG. 2. In particular, two areas 10 are arranged at the side of the first portion 43, and an area 12 is arranged at the central portion 41.

With reference to FIGS. 3 to 5, the massaging unit 23 comprises a pair of interface bodies 230, each of which is substantially C shaped and is coupled to the shell 42 in a known, and therefore not illustrated, manner, at the central portion 41, and it can therefore face the first muscular area RS of a user. Each body 230 extends laterally starting from the area 12 until it covers, in use, the shoulders of a user towards the chest until the thoracic area. The two bodies 230 are furthermore arranged along two respective directions D' and D", symmetrically inclined relative to a longitudinal median plane M of the shell 42. It should be noted that each direction D' and D" has been identified so as to be arranged, in use, between the spine and a shoulder of a user, and therefore to delimit laterally the area RS without interfering with the dorsal portion of the rachis. In view of the above description, each interface body 230 presents curved and concave shape so as to contact the relative shoulder of a user in a substantially conjugated manner, and is delimited longitudinally by a free end portion 231 extending laterally towards the thoracic area in correspondence of the respective lateral portion 45. The two interface bodies 230 are mutually connected inferiorly, as it is shown in FIG. 3, and each of them is centrally provided with a substantially cylindrical elongated member 232, carried in a rotatable and axially fixed manner along the corresponding direction D'/D" with an eccentricity E so as to deform cyclically the coating 46 and, in use, to interact cyclically at the side of the first muscular area RS of a user.

With particular reference to FIG. 3 again, the two interface bodies 230 are substantially V-inclined each relative to the other as the directions D' and D" by an angle $\alpha$ comprised between 50° and 70° relative to the median plane M so as to delimit laterally the area 12 and to interact properly, in use, with the lateral portions of the infrascapular area RS of a user, avoiding interactions with the vertebral bodies for purposes known to those skilled in the art. This angle $\alpha$, calculated based upon average values of users of medium build and various physical proportions, can assume width approximating 60° for the sake of practicality, without however limiting the protective scope of the present invention.

The massaging unit 23 comprises at least one gear motor 236 for each interface body 230. Each gear motor 236 is provided with a drive shaft 2360, coaxial to the elongated member 232 and rigidly connected to this latter so as to actuate it with axial rotatory motion and to produce an effect similar to a pulsing finger pressure in the corresponding scapular area RS through the eccentricity of the elongated member 232. Therefore, the contact between the external portion of the elongated member 232 and the corresponding first area RS of a user will be localised on all the extension of the elongated member 232, which will be therefore equivalent to a single cam longitudinally extending and pulsing with a periodicity linked with the speed of rotation of the member 232. It should be noted that the direction of rotation of the elongated member 232 shall be defined in such a manner as to produce resistances to the circulation, slow the afflux of blood to the area FPZ and a correlated thermal chemical effect on the part so treated. The two elongated members 232 shall therefore rotate in opposite direction and, in particular, the elongated member 232 arranged at the right in FIG. 2 shall rotate in counter clockwise direction for an observer watching from the bottom, whilst the elongated member 232 arranged at the left side of the same FIG. 2 shall rotate in clockwise direction for the same observer.

The massaging unit 23 is delimited at opposite side from the end portions 232, and therefore inferiorly in FIG. 4, by a connected electrical power supply unit 50 comprising a rechargeable battery 52: the battery 52 is electrically connected to each gear motor 236 to supply electricity and it is housed inside a container 54, elongated so as to perform a balancing action for balancing the first portion 43, to avoid an excessive load on the painful muscles to be treated, and to facilitate the operation of varying the pressure on the median area through the action of the lower part of the head. It should be noted that this container 54 is connected to the two interface bodies 230 at the side of the gear motors 236, and it is carried by the interface bodies 230 in a freely rotatable manner so as to follow the physical conformation of the back of a user when the device 1 has been worn.

It should be noted that the action exerted by the massaging unit 23 at the side of the area RS through the respective elongated members 232 is accompanied by a reaction tending to move the shell 42 away from the user's back. Without a contrast action, the consequent motion away results in a decrease in the pressure and therefore in the finger pressure on the muscles of the area RS, and the massage becomes therefore ineffective.

In order to prevent this drawback, the device 1 comprises at least one coupling unit 30 structurally associated with one of the end portions 231 and, therefore, with one of the lateral portions 45. With particular reference to FIGS. 3 and 4, this coupling unit 30 is provided with at least one thoracic retaining member 32, designed so as to cooperate with the operating unit 20 in such a manner as to maintain the shell 42 stable in the given position and the interface bodies 230 stable at the side of the first area RS when the massaging device 1 has been worn and, obviously, also when, in use, the operating unit 20 operates.

In particular, observing frontally the FIGS. 2 and 3, one of the end portions 231 supports the coupling unit 30 and, in particular, the retaining member 32 is arranged in a substantially intermediate position between the first longitudinal portion 43 and the second longitudinal portion 44, so as to exert, on the thoracic/pectoral area, a contrast action of the action of local finger pressure exerted by the massaging unit 23 on the muscular area RS. The coupling unit 30 has therefore the function of contrasting this reaction force, avoiding the device from moving away from the user's back, therefore maintaining the device into contact with the user's back, thus assuring the effectiveness of the massage.

Without limiting the protective scope of the present invention, each retaining member 32 presents a substantially circular shape and comprises a disc 320, to which a padding 322 is associated, at the side of the shell 42, suitable to make the contact with the pectoral area of the user of the massaging device 1 more soft.

Furthermore, to make the massaging device 1 easy to be worn, the coupling unit 30 comprises a coupling group 34 arranged between each retaining member 32 and the respective end portion 231 to support the member 32 and to make it rotatably movable around a first fulcrum axis 340 associated with one corresponding end portion 231/lateral portion 45 between a blocking lowered position, shown in FIG. 3, associated with the use of the massaging device 1, and a wearing lifted position, shown in FIG. 4, useful for the preparatory phase for the use of the device 1 and the phase of end of use thereof. With particular reference to FIGS. 6 and 7, the coupling group 34 is provided with two paired projections 343, extending from the end portion 231 to define a housing and to support rotatably the retaining member 32 through the interposition of a shaft 323 arranged rigidly between the two projections 343 in a manner selectively lockable in rotation relative to the massaging unit 23 in any position comprised between the lifted position of FIG. 4 and the lowered position of FIG. 3 through a ratchet gear 342. The shaft 323 presents a head 323' in end position and the ratchet gear 342 comprises a sleeve 345 carried by the shaft 323 coaxial to the axis 340. This sleeve 345 carries the retaining member 32 and presents a face 346 transverse to the first fulcrum axis 340 provided with a plurality of front recesses 347 arranged radially around the first axis 340 facing the head 323'. The ratchet gear 342 furthermore comprises a pin 348 parallel to the first fulcrum axis 340 housed inside a through hole 321, obtained transversally in the head 323' and provided with a head 349 shaped so as to house in each recess 347 in a substantially conjugated manner.

The ratchet gear 342 furthermore comprises a lever 341, arranged transversally to the first fulcrum axis 340 and carried rotatably around a second axis 344 transverse to the first axis 340 through a pair of brackets 344' carried integrally by the head 323'. Furthermore, the lever 341 is coupled in a rotatable manner to the pin 348 by means of a respective eyelet 348' to actuate it longitudinally from and towards an engaging position of each recess 347 currently facing the head 349 of the pin 348 so as to unlock selectively in rotation the sleeve 345 and to allow the recesses 347 to rotate to position the retaining member 32 with a given inclination relative to the shell 42 and to the interface bodies 230. In this way, in view of the above description it is possible to adjust at will an intensity of the action of finger pressure, which can be exerted by the massaging unit 23 between the scapular regions.

With reference to FIGS. 6 and 7 again, the ratchet gear 342 comprises a spring 350 carried parallel to the pin 348 to contrast, in use, an extraction from a recess 347; the lever 341 is delimited axially at opposite side from the pin 348 by an actuating button 352 suitable to act as user interface to control the extraction of the head 349 of the pin 348 from the respective recess 347. This button is covered by a push button 353 in flexible plastic material protecting the ratchet gear 342.

In view of the above description, the ratchet gear 342 is shaped so as to rotate the retaining member 32 with the pressure of a hand starting from its rest position, shown in FIG. 1*b*) and 4, until to bring the respective padding 322 into contact with the chest of a user in its operating position, shown in FIG. 1*a*) and 3, and to be selectively snap unlockable by this latter, as it will be better understood in the description below. In this operating position, shown in FIG. 1*a*) and 3, the retaining member 32 can validly exert its contrast action of the rear thrust exerted by each member 232.

In addition, it can be useful to note that, in use, due to the matching contact produced between the first longitudinal portion 43 and the upper portion of the neck of a user and between the second longitudinal lower portion 44 and the infrascapular position when the massaging device 1 is worn, the retaining member 32 arranged in the lowered position of FIG. 3 is suitable to act as a fulcrum for the shell 42 and the frame 5, and consequently the first can be assimilated to a first-class lever delimited by the first longitudinal portion 43 and by the second longitudinal portion 44, and the retaining member 32 is the fulcrum of this lever. This allows, in use, to modulate at will an intensity of the local finger pressure, which can be exerted by the massaging unit 23 through a thrust action which can be applied as a lever from the first portion 43 by the head of a user, through the respective occipital region, to transfer this action to the second portion 44 at opposite side from the retaining member 32, between the user's scapulas, or vice versa. In view of the above description, the retaining member 32 can be interpreted as a modulating member for modulating the intensity of the massage which can be exerted in the area RS of a user through the massaging unit 23 simply by acting on the first portion 43 with the base of the head.

The device 1 furthermore comprises a heating unit 60, arranged transversally between the two lateral portions 45 and longitudinally between the first longitudinal portion and the area 12, therefore in a position above and adjacent to the elongated members 232 to supply, in use, heat at a given temperature from the areas 10 and therefore to radiate the areas FPZ of a user shown in FIG. 2, arranged between the first rear central region RS and the second central region CR. With particular reference to FIG. 3, the heating unit 60 comprises a grid 62 with high electric resistance for each interface body 230 upstream of each wend portion 231; each grid 62 is connected in a known, and therefore not shown, manner to the battery 52 to supply heat through Joule effect and to heat the muscular regions FPZ.

It should be noted, only incidentally, that the choice of combining the action of the massage and the application of heat in muscular tension cervicodynia in the areas indicated above has the function of mechanically limiting the blood afflux, to reduce the muscular inflammation and, respectively, to stimulate the production of endorphins through a temperature increase.

The device 1 furthermore comprises a switch 238 carried inferiorly in FIG. 3, designed so as to switch the electric connection between the battery 52 and the gear motors 236 from a rest condition to a functioning condition as well as to actuate or to stop the supply of heat by the grids 62. Obviously, this switch 238 can be designed so as to allow to vary at will the speed of rotation of the shaft 2360, as well as the heat flow produced by the grids 62 according to the needs of the user or in conditions of low charge of the battery 52. It should be specified that the electrical connections between the battery 52 and the gear motors 236, between the battery 52 and the grids 62 are not drawn in the attached tables for the sake of practicality. The only connection shown is that between the battery 52 and the switch 238, for the same purpose.

The use of the massaging device 1 is clearly apparent from the description above and requires no further explanations. However, it should be advisable to specify that the separation of the massaging and heating functions and the particular conformation of the shell 42, covering the units that must perform these functions on the areas affected by the muscle contracture and the pain connected to it, represent a substantial contribution that makes this invention valid even if simple. This factor must not deceive, as, even if it can seem unusual, the massaging device 1 presents for the first time an electromechanical structure designed to follow precisely the real needs of the users suffering from muscular-tension cervicodynia based upon the correct application of know-how deriving from the study of the human physiology. Furthermore, the identification of the two directions for the elongated members 232 and 232' allows to maintain the massaging unit 23 in the infrascapular region of users of a wide range of sizes; this makes the device 1 usable by people of different body dimensions to obtain the same benefits.

In view of the above description it is clearly apparent that the coupling unit 30 can comprise two retaining members 32, one for each interface body 230/each lateral portion 45, without however varying the protective scope of the present invention.

Lastly, it is apparent that modifications and variants can be made to the massaging device 1 described and illustrated herein, without however departing from the protective scope of the present invention.

For example, alternatively to what has been described above, the elongated member 232 can be validly replaced with an elongated member 232', shaped so as to be carried coaxially to the axis of the gear motor 236 and provided with a plurality of radial projections 234 mutually displaced in a given manner so as to simulate a finger pressure movable along the respective direction D' or D". The distribution of the radial projections 234, which can be also continuous and can be actuated through a substantially helical profile, known and therefore not shown, can involve only an angular portion of the elongated body 232' of extension lower than 360°. In this way it would be possible to use the elongated member 232' to exert, in use, the effect of a finger pressure moving from a given point to another point and then starting again from the same given point, maintaining constantly a single direction of propagation/motion along the direction D' or D". If deemed advisable, it is also possible to modify the shell 42 and the frame 5 so as to allow the installation of elongated members of given shape, to produce massaging effects of various type. In this case it is possible to provide fast coupling connections to couple each elongated member 232/232' to a corresponding shaft 2360 of the gear motor 236 or an elongated member of different shape, according to the needs of the user.

In view of the above description, it is easy to understand that each version of the massaging device 1 described above can be validly used to treat in a combined manner a muscular region near the cervical and dorsal rachis of users of different sizes with a heating action and an action similar to a local finger pressure of entity adjustable at will, in use, in a particularly new and original manner. Furthermore, the lack of bands allows to treat the cervicodynia locally, avoiding useless constriction of the thoracic areas of the users, so as to avoid increase in the pain in acute phase.

The invention claimed is:

1. A massaging device for a dorsal region of a user, comprising:

a frame having a shell which is provided with a central portion adapted to couple, in use, with a first muscular region substantially associated with a scapular area of the user and delimited at a top by a first longitudinal portion shaped so as to be adapted to couple with a cervical rachis of the user and a second longitudinal portion adapted to cover a subscapular area of the user; wherein said shell comprising two substantially concave lateral members, each of the concave lateral members extending at a side of said first longitudinal portion and adapted to cover, in use, a shoulder of the user in a substantially complete manner in order to maintain, in use, said shell in a given stable position with said first portion into contact with the cervical rachis and with the respective central portion facing said first muscular region; at least one of said concave lateral members extending towards a chest of the user with a thoracic retaining member carried by a respective laterally extending end portion of at least one said concave lateral member to be associated, in use, to a pectoral area of the user, wherein the thoracic retaining member is designed to couple with a thoracic area of the user to maintain said shell stably in said given stable position;

wherein a coupling group is associated with the thoracic retaining member and is carried by said end portion to support said thoracic retaining member in a rotatable manner around a respective first fulcrum axis and selectively fixed between a lifted position of wearing and a lowered position of blocking, into stable contact with said thoracic area to contrast selectively a movement of said central portion away from a back of the user.

2. A device according to claim 1, wherein said end portion carries rigidly a shaft coaxial to said first axis and wherein said coupling group comprises a ratchet gear coupled to said shaft and provided with a sleeve coupled rotatably to said shaft and supporting in a fixed manner said thoracic retaining member.

3. A device according to claim 2, wherein said shaft presents an end head provided with a seat for a pin parallel to said first fulcrum axis, and said sleeve presents a face transverse to said first fulcrum axis and provided with a plurality of front recesses; wherein said pin being provided with a head shaped to house in each said front recess in a substantially conjugated manner.

4. A device according to claim 3, wherein said ratchet gear comprises a lever arranged transversally to said first fulcrum axis and carried rotatably around a second axis transverse to said first fulcrum axis; said lever being furthermore coupled to said pin in a rotatable manner so as to actuate it longitudinally from and to an engaging position of said front recess in such a way as to unlock selectively in rotation said sleeve and to orient said thoracic retaining member in a given manner relative to said shell, in order to adjust an intensity of an action of finger pressure which can be exerted by a massaging unit.

5. A device according to claim 4, wherein said ratchet gear comprises a spring carried parallel to said pin so as to prevent, in use, an extraction of said head from said front recess; an actuating button being carried by said lever at opposite side from said pin suitable to act as user interface to control the extraction of said head from said front recess in order to facilitate a respective actuation thereof.

6. A device according to claim 1, further comprising a massaging unit arranged at said central portion and comprising a pair of interface bodies, each of which is substantially C-shaped and is provided with said end portion at a side of the chest of the user.

7. A device according to claim 1, further comprising a massaging unit provided with a pair of elongated members symmetrically inclined relative to a longitudinal median plane of said shell along two respective directions, each of which being arranged, in use, between said first muscular region and one of the shoulders of the user.

8. A device according to claim 7, wherein each said elongated member is carried in a freely axially rotatable manner and is designed to produce a longitudinally distributed pulsing effect; said massaging unit comprising at least a gear motor axially connected to said elongated member in order to actuate it with an axial rotatory motion and to produce at a side of said first muscular region an effect similar to a finger pressure through each radial projection.

9. A device according to claim 7, wherein said two directions are mutually inclined substantially in V-shape by an angle of between 50° and 70° so that each said elongated member interacts, in use, laterally to said first muscular region.

10. A device according to claim 7, wherein said two directions are mutually inclined substantially in V-shape by an angle of approximating 60° so that each said elongated member interacts, in use, with a respective said first muscular region.

11. A device according to claim 7, wherein said elongated member comprises an eccentric cylinder or a cylinder provided with a plurality of radial projections mutually displaced in a given manner, so as to simulate a longitudinally movable finger pressure.

12. A device according to claim 1, further comprising a heating unit arranged between said first longitudinal portion and said second longitudinal portion so as to supply, in use, heat at a given temperature in a neighborhood of a second muscular region arranged laterally above said first muscular region.

13. A device according to claim 12, wherein said heating unit comprises at least one grid, which can be used to supply heat through Joule effect.

14. A device according to claim 13, wherein said shell presents a longitudinal median plane, extending between said first longitudinal portion and said second longitudinal portion, wherein said shell is shaped in a substantially symmetrical manner relative to said median plane and said heating unit comprising a pair of said grids arranged in a substantially symmetrical manner relative to said median plane.

15. A device according to claim 7, further comprising an electrical power supply unit comprising a rechargeable battery; said battery being electrically connected to each gear motor of the massaging unit; a switch being associated to said shell in order to switch an electrical connection between said battery and each said gear motor so as selectively to cause a rest condition thereof or a functioning condition thereof and/or to adjust a supply of heat by grids.

16. A device according to claim 15, wherein said battery is housed inside a container carried by at least one interface body of the massaging unit in a freely rotatable manner so as, in use, to follow a physical conformation of a back of said user.

* * * * *